US006398607B1

(12) United States Patent
Pan et al.

(10) Patent No.: US 6,398,607 B1
(45) **Date of Patent: *Jun. 4, 2002**

(54) TAILORED SPACER STRUCTURE COATING

(75) Inventors: Lawrence S. Pan, Pleasanton; Colin D. Stanners; Theodore S. Fahlen, both of San Jose, all of CA (US)

(73) Assignee: Candescent Intellectual Property Services, Inc., San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/680,989

(22) Filed: Oct. 6, 2000

Related U.S. Application Data

(63) Continuation of application No. 09/126,701, filed on Jul. 30, 1998, now Pat. No. 6,149,483.

(51) Int. Cl.[7] ..... H01J 9/38
(52) U.S. Cl. ..... 445/24; 445/59
(58) Field of Search ..... 445/24, 59

(56) References Cited

U.S. PATENT DOCUMENTS 3,410,723 A * 11/1968 Cohz ..... 445/59
3,944,868 A * 3/1976 Kupsky ..... 313/517
5,433,639 A * 7/1995 Zahuta et al. ..... 445/40
5,543,683 A * 8/1996 Haven et al. ..... 313/461
5,777,432 A * 7/1998 Xie ..... 313/495
5,883,467 A * 3/1999 Chalamala et al. ..... 313/553
6,004,180 A * 12/1999 Knall et al. ..... 445/59
6,149,483 A * 11/2000 Pan et al. ..... 445/24

* cited by examiner

*Primary Examiner*—Kenneth J. Ramsey
(74) *Attorney, Agent, or Firm*—Wagner, Murabito & Hao LLP

(57) ABSTRACT

A flat panel display that has internal components that are cleaned using a dry cleaning treatment. The cleaned internal components include a matrix structure, a focus structure and a support structure. The dry cleaning treatment removes contaminants from the surfaces of the internal components. By cleaning the internal components, contaminants are removed that can deleteriously affect the performance of the display. The cleaned support structure has uniform resistance and does not produce spatially nonuniform resistivity over time. This prevents regions of the visible display that are not properly illuminated and minimizes the possibility of arcing.

1 Claim, 8 Drawing Sheets

TAILORED SPACER STRUCTURE COATING

This is a continuation of application(s) Ser. No. 09/126,701 filed on Jul. 30, 1998, now U.S. Pat. No. 6,149,483, which is hereby incorporated by reference to this specification.

FIELD OF THE INVENTION

The present claimed invention relates to the field of flat panel displays. More particularly, the present claimed invention relates to the internal components of a flat panel display.

BACKGROUND ART

Prior art flat panel displays include a backplate that includes a matrix structure of rows and columns of electrodes. One such flat panel display is described in U.S. Pat. No. 5,541,473 titled GRID ADDRESSED FIELD EMISSION CATHODE that is incorporated herein by reference as background material. Typically, the backplate is formed by depositing a cathode structure (electron emitting) on a glass plate. The cathode structure includes emitters that generate electrons. The backplate typically has an active area within which the cathode structure is deposited. Typically, the active area does not cover the entire surface of the glass plate, leaving a thin strip that extends around the glass plate. Electrically conductive traces extend through the thin strip to allow for connectivity to the active area.

Prior art flat panel displays include a thin glass faceplate having one or more layers of phosphor deposited over the interior surface thereof. The faceplate is typically separated from the backplate by about 1 to 2 millimeters. The faceplate includes an active area within which the layer (or layers) of phosphor is deposited. The faceplate is attached to the backplate using a glass seal that extends around the active areas of the faceplate and the backplate.

Sub-pixel regions on the faceplate of a flat panel display are typically separated by an opaque mesh-like structure commonly referred to as a matrix or "black matrix." By separating sub-pixel regions, the black matrix prevents electrons directed at one sub-pixel from overlapping another sub-pixel. In so doing, a conventional black matrix helps maintain color purity in a flat panel display. Polyimide material is commonly used to form the black matrix. In addition, if the black matrix is three dimensional (i.e. it extends above the level of the light emitting phosphors), then the black matrix can prevent some of the electrons back scattered from the phosphors of one sub-pixel from impinging on another, thereby improving color purity.

A support structure extends between the faceplate and the backplate. This support structure overlies the black matrix and assures uniform spacing between the faceplate and the backplate. The support structure is typically formed of ceramic material. The support structure may be walls, pins, or any of a number of other shapes.

A focusing structure that is formed over the active area of the backplate directs electron emission from the cathode. More particularly, the focusing structure is formed within the active area of the cathode for directing emissions from emitters. The focusing structure is commonly formed using Polyimide.

The faceplate of a field emission cathode ray tube requires a conductive anode electrode to carry the current used to illuminate the display. Conventional internal structures within the flat panel display include a support structure. Over time, repeated electron bombardment causes the electrical characteristics of the support structure to vary over time. More particularly, the resistance of the support structure changes over time, resulting in spatially nonuniform resistivity. This deleteriously effects the visible image produced. More particularly, spatially nonuniform resistivity causes the deflection of an electron beam either towards or away from the support structure. This produces regions within the visible display that are not properly illuminated. When walls are used as support structures, the deflection of electrons causes visible lines that extend across the visible display. Also, spatially nonuniform resistivity can result in arcing.

Thus, a need exists for a flat panel display that does not produce regions of the visible display that are not properly illuminated as the electrical characteristics of internal components degrade over time. More particularly, a need exists for internal components that do not have varying resistivity over time and that do not produce spatially nonuniform resistivity.

SUMMARY OF THE INVENTION

The present invention provides internal components that do not produce regions of the visible display that are not properly illuminated as internal components degrade over time. This is accomplished by using internal components that do not have varying resistivity over time and that do not produce spatially nonuniform resistivity. The present invention provides internal components and methods for dry cleaning internal components so as to meet both of the above needs.

Specifically, in one embodiment, the present invention is comprised of a matrix structure that is adapted to be coupled to a faceplate of a flat panel display. The matrix structure is located on the faceplate so as to separate adjacent sub-pixel regions. The present invention also includes a support structure and a focus structure. The matrix structure and the support structure are internal components of the flat panel display that are disposed between the faceplate and the backplate.

The internal components (e.g. the matrix structure, the focus structure and the support structure) are cleaned using a dry cleaning treatment. In one embodiment, the dry cleaning treatment uses an oxygen plasma. Alternatively, a hydrogen plasma or an argon plasma is used. In yet another embodiment, an ozone that is applied in a UV radiation environment is used.

By cleaning the internal components with a dry cleaning treatment, resistivity in the support structure does not vary over time, preventing spatially nonuniform resistivity from developing. Hence, the present invention achieves electrical stability by providing a support structure that has electrical characteristics that do not change over time, which reduces the possibility of arcing and regions of the visible display that are not properly illuminated.

These and other objects and advantages of the present invention will no doubt become obvious to those of ordinary skill in the art after having read the following detailed description of the preferred embodiments that are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

The drawings referred to in this description should be understood as not being drawn to scale except if specifically noted.

DESCRIPTION OF THE PREFERRED EMBODIMENTS

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, and components have not been described in detail so as not to unnecessarily obscure aspects of the present invention.

Figure 1:
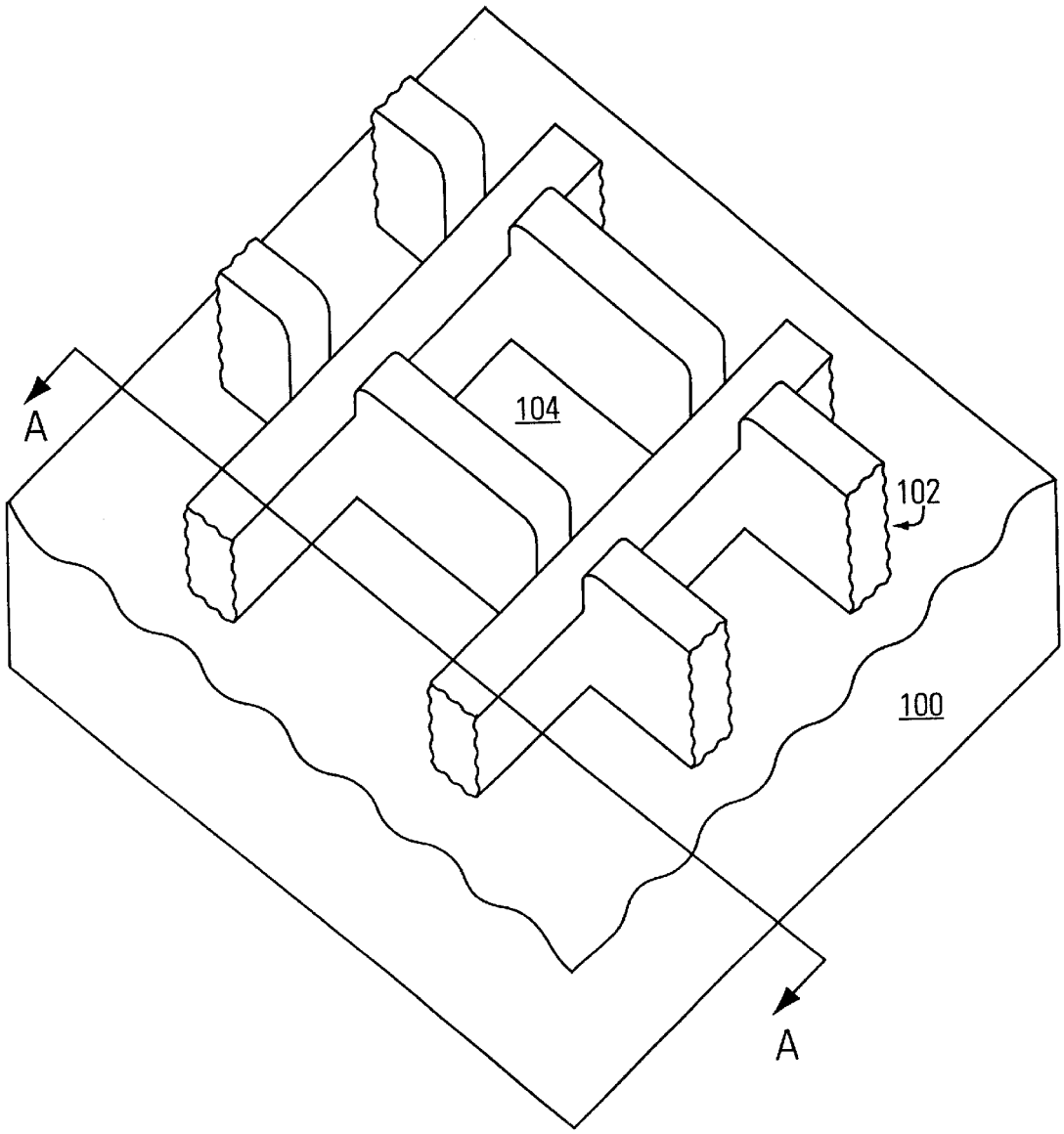
FIG. 1 is a perspective view of a faceplate of a flat panel display device having a matrix structure disposed thereon in accordance with one embodiment of the present claimed invention.

FIG. 1 shows a perspective view of a faceplate 100 of a flat panel display device having a matrix structure 102 coupled thereto. In the embodiment of FIG. 1, matrix structure 102 is located on faceplate 100 such that the rows and columns of matrix structure 102 separate adjacent sub-pixel regions, typically shown as 104. Additionally, in the present embodiment, matrix structure 102 is formed of Polyimide material. Although matrix structure 102 is formed of Polyimide material in the present embodiment, the present invention is also well suited to use with various other matrix forming materials that may cause deleterious contamination. As an example, the present invention is also well suited for use with a matrix structure that is comprised of a photosensitive Polyimide formulation containing components other than Polyimide.

With reference still to FIG. 1, matrix structure 102 is a "multi-level" matrix structure. That is, the rows of matrix structure 102 have a different height than the columns of matrix structure 102. The present invention is, however, well suited to use with a matrix structure that is not multi-level. Although the matrix structure of the present invention is sometimes referred to as a black matrix, it will be understood that the term "black" refers to the opaque characteristic of the matrix structure. That is, the present invention is also well suited to having a color other than black. Furthermore, in the following Figures, only a portion of the interior surface of a faceplate is shown for purposes of clarity. Additionally, the following discussion specifically refers to a matrix structure 102 that is cleaned using a dry cleaning treatment. Although such a specific recitation is found below, the present invention is also well suited for use with various other internal components of a flat panel display device. Also, although some embodiments of the present invention refer to a matrix structure for defining pixel and/or sub-pixel regions of the flat panel display, the present invention is also well suited to an embodiment in which the pixel/sub-pixel defining structure is not a "matrix" structure. Therefore, for purposes of the present application, the term matrix structure refers to a pixel and/or sub-pixel defining structure and not to a particular physical shape of the structure.

Figure 2:
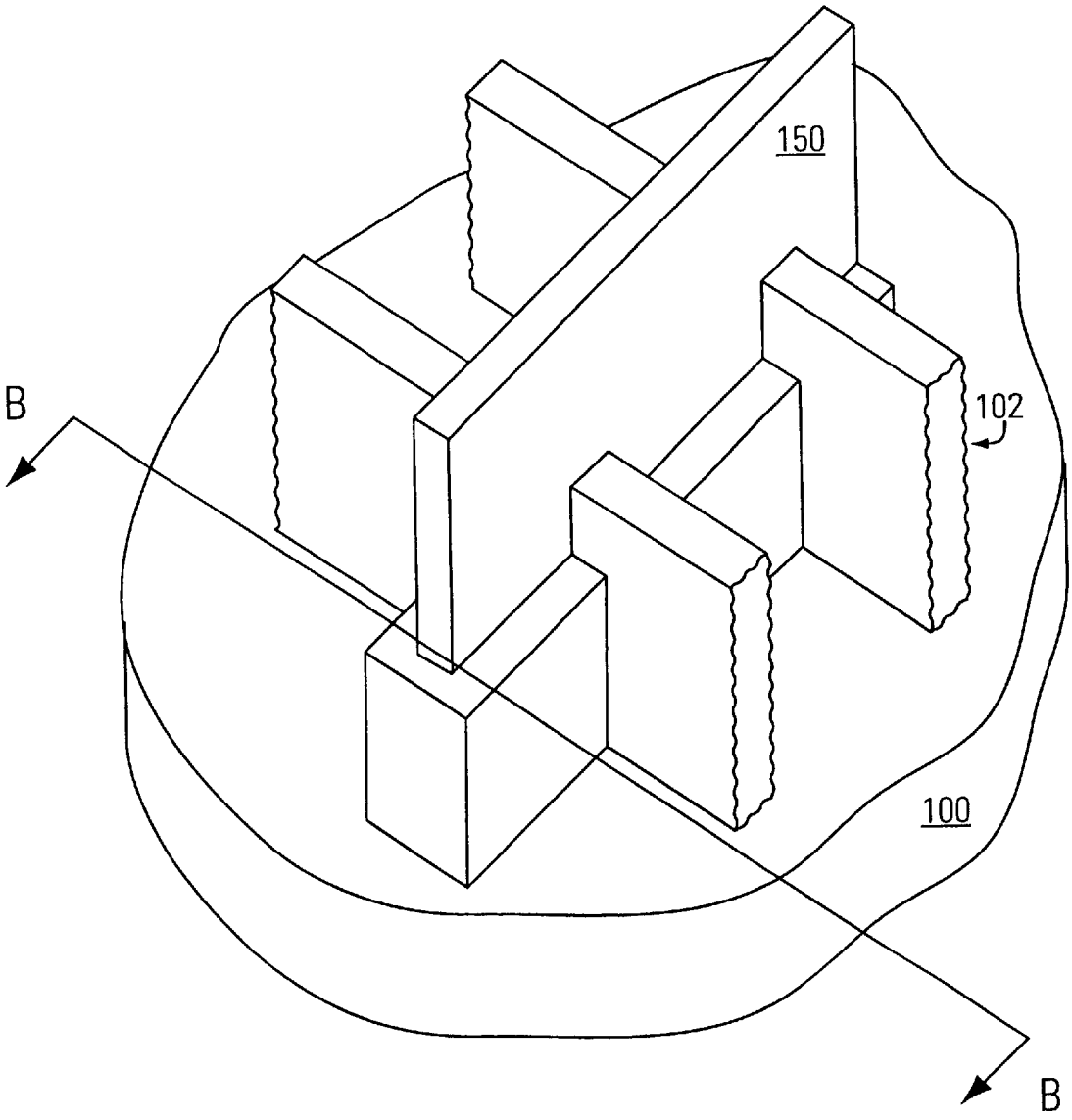
FIG. 2 is a perspective view of a flat panel display device showing a support structure that is to be cleaned using a dry cleaning treatment in accordance with one embodiment of the present claimed invention.

Referring now to FIG. 2, support structure 150 is shown to be disposed over matrix structure 102 in accordance with one embodiment of the present claimed invention. As will be described below, in the present embodiment, support structure 150 is cleaned using a dry cleaning treatment. That is, the dry cleaning treatment cleans the surfaces of support structure 150. This produces a support structure 150 that has electrical characteristics that will not degrade over time, giving uniform resistance and preventing spatially nonuniform resistivity on support structure 150.

Continuing with FIG. 2, the present invention is well suited for use with other types of support structures. Thus, the present invention is also well suited to an embodiment in which the support structure is comprised of, for example, pins, balls, columns, or various other shapes of supporting structures. Also, the present invention is well adapted for use with supporting structures that are made of material other than ceramic. In particular, the present invention is compatible for use with a support structure that contains conductive elements such as, for example, metal lines, conductive strips, etc.

Figure 3:
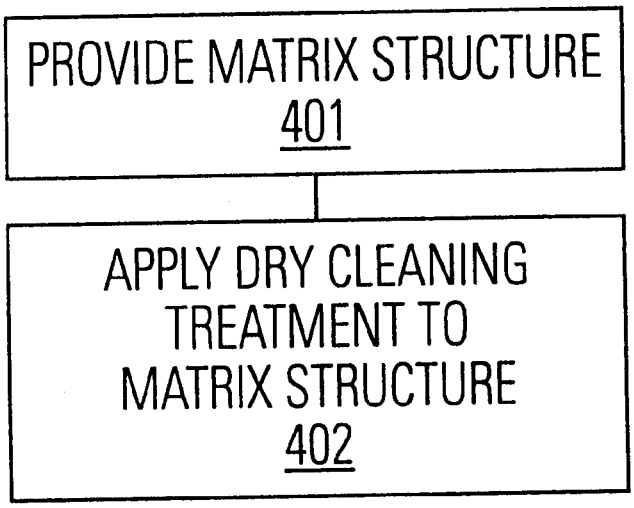
FIG. 3 is a diagram showing a method for forming a matrix structure that is cleaned using a dry cleaning treatment in accordance with one embodiment of the present claimed invention.

Referring now to FIG. 3, a method for forming a matrix structure is shown. First, as shown by block 401, a matrix structure is provided. This matrix structure is then exposed to a dry cleaning treatment as shown by step 402. In one embodiment, the dry cleaning treatment consists of the application of ozone in an Ultraviolet (UV) radiation environment. In one embodiment, a conventional Chemical Vapor Deposition (CVD) chamber is used to apply the dry cleaning treatment. In one embodiment, the dry cleaning treatment uses a UV laser beam to decompose liquid or solid organic material into gaseous products which can be removed as a vapor. A pulsed laser beam can be used to remove small particulate matter by a photo acoustic process.

Continuing with FIG. 3, upon the application of dry cleaning treatment as shown by step 402, residual contaminants are removed from the surfaces of the matrix structure. These contaminants include carbon and carbon containing compounds.

Figure 4:
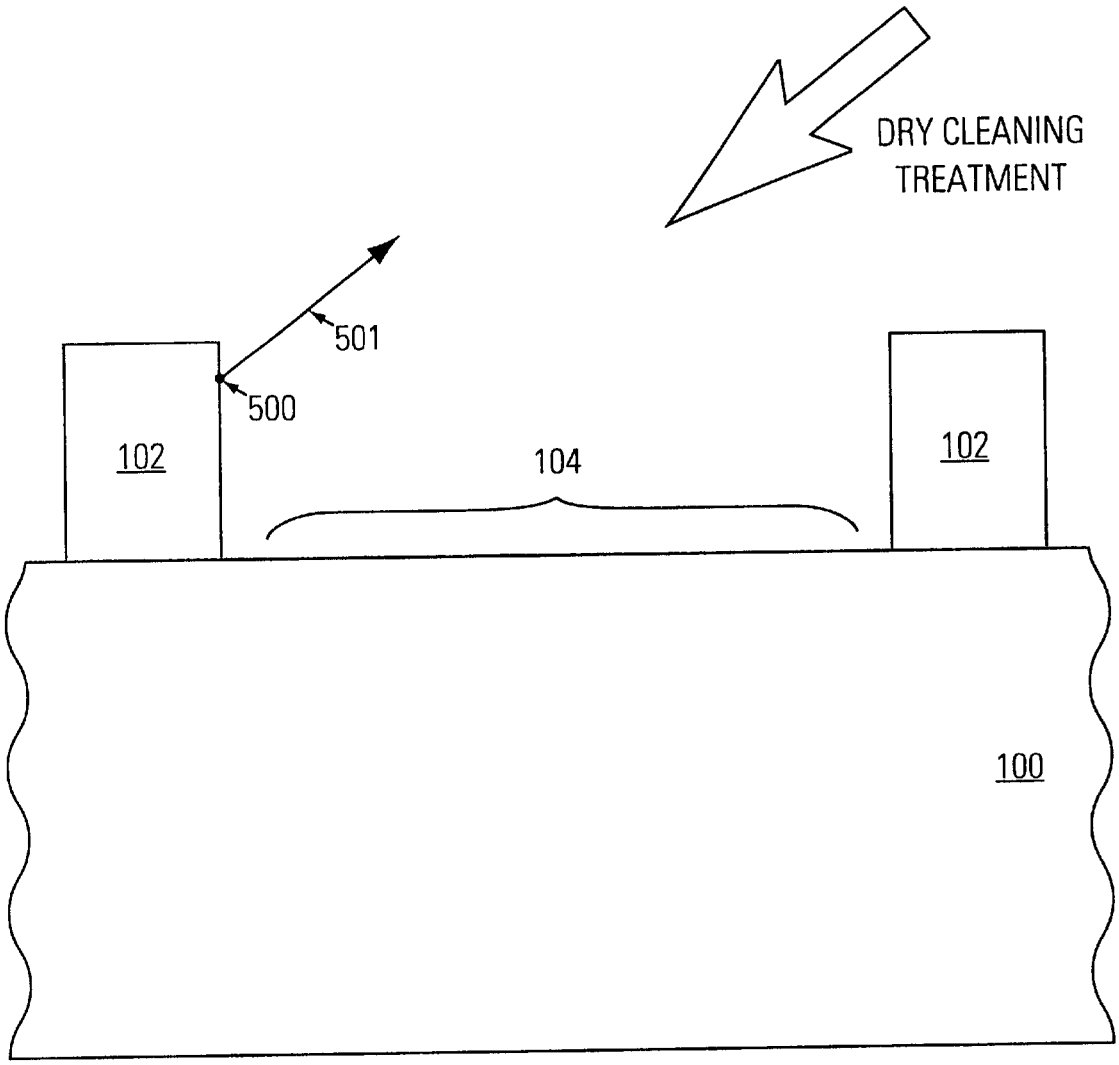
FIG. 4 is a side sectional view of the faceplate and matrix structure of FIG. 1 taken along line A—A wherein the matrix structure is cleaned using a dry cleaning treatment in accordance with one embodiment of the present claimed invention.

With reference now to FIG. 4, a side sectional view of faceplate 100 and matrix structure 102 is shown. In the side sectional view, only a portion of matrix structure 102 is shown for purposes of clarity. It will be understood, however, that the above-described steps are performed over much larger portions of matrix structure 102 and are not limited only to those portion of matrix structure 102 shown in FIG. 4. Additionally, the above-described steps used in the formation of the present invention are also well suited to an approach in which a preliminary bake-out step is used to initially purge some of the contaminants from the matrix. In a bake-out step, the matrix structure 102 is heated prior to placing the matrix structure 102 in the sealed vacuum environment of the flat panel display.

Referring again to FIG. 4, when a dry cleaning treatment such as dry cleaning treatment 402 of FIG. 3 is applied to matrix structure 102, contaminants such as contaminant 500 are removed from the surface of matrix structure 102 as shown by arrow 501. The removal of contaminant 500 from the surface of matrix structure 102 provides a matrix structure 102 that has significantly reduced surface contaminant levels. This prevents contaminants such as contaminant 500 from being removed from matrix structure and deposited elsewhere. Thus, contaminant 500 will not deleteriously affect the display produced. That is, by cleaning matrix structure 102, contaminants are removed that can deleteriously affect the performance of the display when the contaminants leave the matrix structure.

Figure 5:
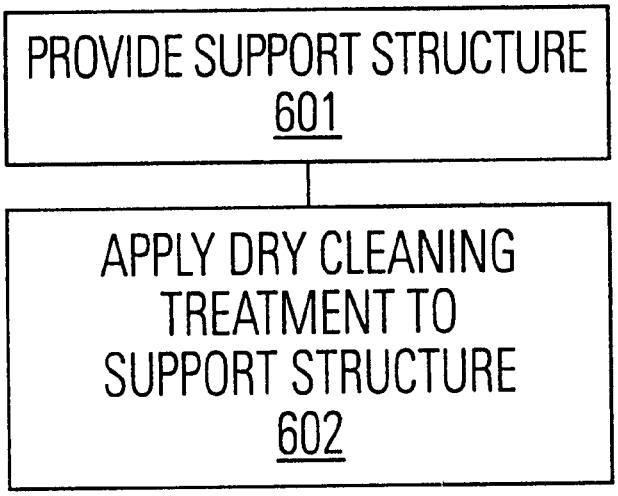
FIG. 5 is a diagram showing a method for forming a support structure that is cleaned using a dry cleaning treatment in accordance with one embodiment of the present claimed invention.

Referring now to FIG. 5, a method for forming a support structure that has electrical characteristics that do not degrade over time is shown. First, a support structure is provided as shown by step 601. The support structure may be a support structure such as support structure 150 shown in FIG. 2.

Continuing with FIG. 5, as shown by step 602, a dry cleaning treatment is performed so as to clean the support structure. In one embodiment, the dry cleaning treatment consists of a plasma treatment such as the application of an oxygen plasma. Alternatively, a hydrogen plasma or an argon plasma is used. In one embodiment, the dry cleaning treatment is applied using a RF Plasma Etcher. Alternatively, a conventional Chemical Vapor Deposition (CVD) chamber is used to apply the dry cleaning treatment. In one embodiment, the dry cleaning treatment consists of the application of ozone in a Ultra Violet (UV) radiation environment. When a plasma treatment is used, the support structure is cleaned before it is deposited over the faceplate. This prevents possible damage to the faceplate from the plasma treatment. However, alternatively, the support structure may be cleaned after it is deposited over the faceplate when the dry cleaning treatment consists of the application of ozone in a UV radiation environment. In one embodiment, the dry cleaning treatment uses a UV laser beam to decompose liquid or solid organic material into gaseous products which can be removed as a vapor. A pulsed laser beam can be used to remove small particulate matter by a photo acoustic process.

Figure 6:
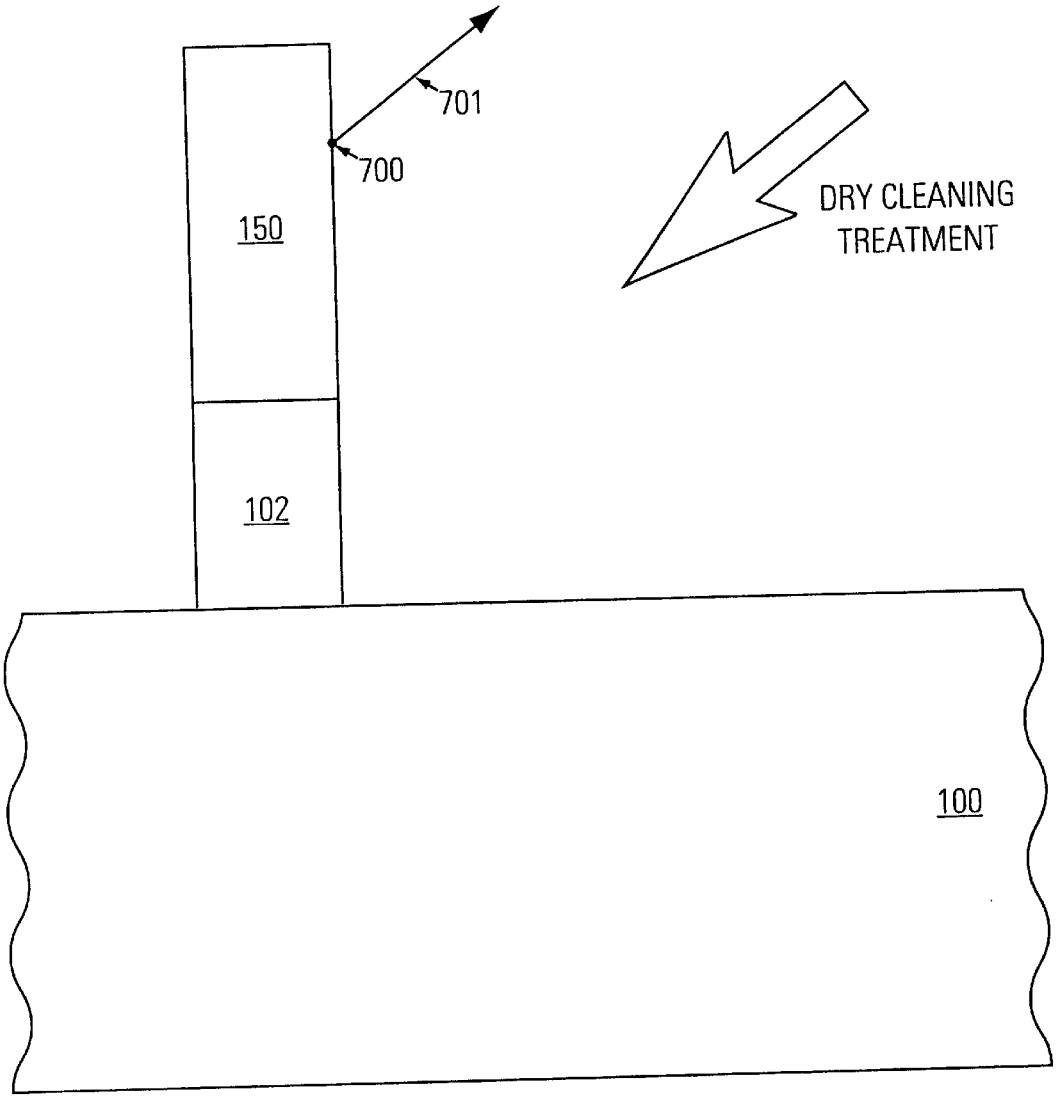
FIG. 6 is a side sectional view of the structure of FIG. 2 taken along line B—B wherein the support structure is cleaned using a dry cleaning treatment in accordance with one embodiment of the present claimed invention.

Referring now to FIG. 6, when a dry cleaning treatment such as dry cleaning treatment shown in step 602 of FIG. 5 is applied to support structure 150, contaminants such as contaminant 700 which is located on the surface of support structure 150 are removed as shown by arrow 701. The removal of contaminants such as contaminant 700 from the surface of support structure 150 provides a support structure 150 that has significantly reduced surface contaminant levels. This produces a support structure 150 that has electrical characteristics that will not degrade over time, giving uniform resistance and preventing spatially nonuniform resistivity on support structure 150.

Though the dry cleaning treatment of matrix structure 102 and the dry cleaning treatment of support structure 150 is described as separate steps, matrix structure 102 and support structure 150 may be cleaned using a single dry cleaning treatment step. However, plasma cleaning may damage the active areas of the faceplate. Therefore, when both the support structure and the matrix structure are to be cleaned together, the dry cleaning treatment may consist of the application of ozone in a Ultra Violet (UV) radiation environment. Depending on the manufacturing criteria for making a particular display assembly, it may be more efficient and more cost effective to clean both matrix structure 102 and support structure 150 in a single dry cleaning treatment step.

Figure 7:
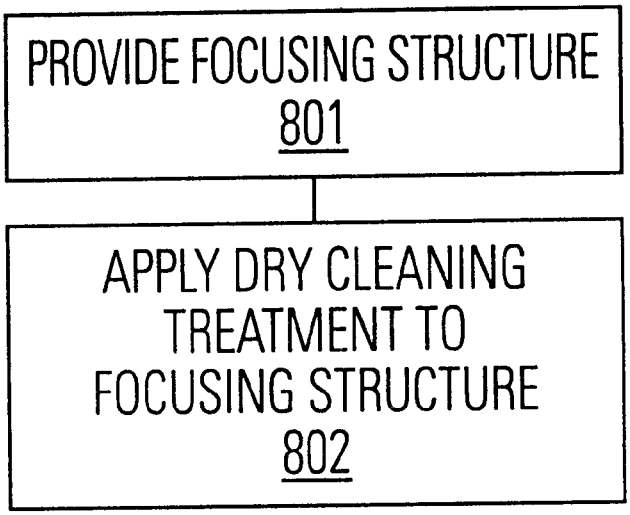
FIG. 7 is a diagram showing a method for forming a focusing structure that is cleaned using a dry cleaning treatment in accordance with one embodiment of the present claimed invention.
Figure 8:
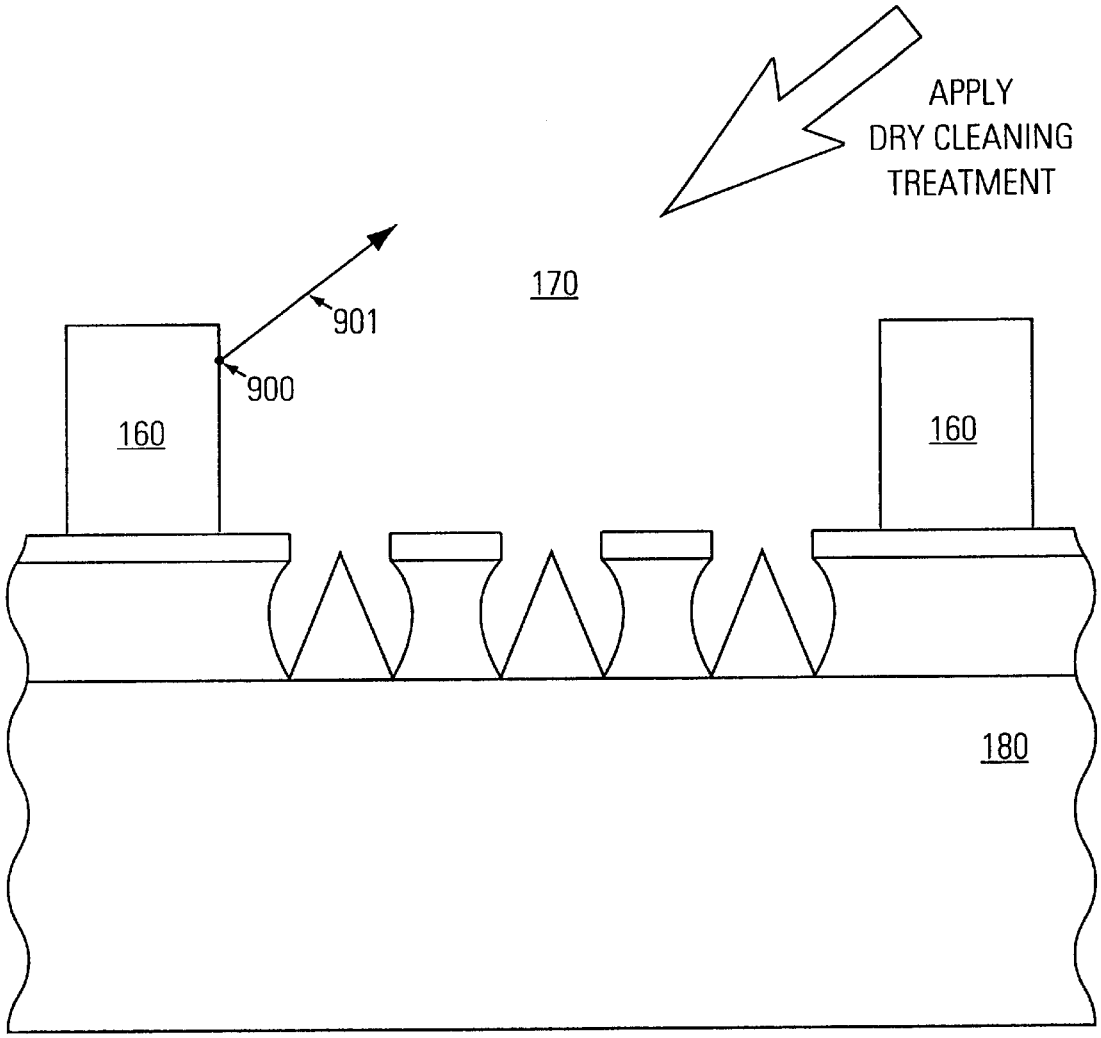
FIG. 8 is a side sectional view of a focus structure of a flat panel display device showing the use of a dry cleaning treatment to clean the focusing structure in accordance with one embodiment of the present claimed invention.

Referring now to FIGS. 7–8, in one embodiment of the present invention, the physical components of a flat panel display include a focusing structure that is cleaned using a dry cleaning treatment. Referring now to FIG. 7, a focusing structure is provided as shown by step 801. FIG. 8 shows a cross sectional view of focusing structure 160 that is disposed over a backplate 180.

Continuing with FIG. 7, as shown by step 802, a dry cleaning treatment is performed so as to clean the focusing structure. In one embodiment, the dry cleaning treatment consists of the application of an oxygen plasma. Alternatively, a hydrogen plasma or an argon plasma is used. In one embodiment, the dry cleaning treatment is applied using an RF Plasma Etcher. Alternatively, a conventional Chemical Vapor Deposition (CVD) chamber is used. In one embodiment, the dry cleaning treatment consists of the application of ozone in a Ultra Violet (UV) radiation environment. In one embodiment, the dry cleaning treatment uses a UV laser beam to decompose liquid or solid organic material into gaseous products which can be removed as a vapor. A pulsed laser beam can be used to remove small particulate matter by a photo acoustic process.

Referring now to FIG. 8, a focusing structure 160 is shown to be formed over backplate 180. Focusing structure 160 is operable to focus emissions from emitters 170. When a dry cleaning treatment such as dry cleaning treatment shown in step 802 of FIG. 7 is applied to focus structure 160, contaminants such as contaminant 900 are removed from the surface of focusing structure 160 as shown by arrow 901.

Though the present invention is described with reference to specific internal components that are sealed between the faceplate and the backplate of a flat panel display (e.g. a matrix structure, a focusing structure and a support structure), the present invention is also well adapted for use with any internal component of a flat panel display that is subjected to electron bombardment. The present invention is also applicable with various other matrix forming materials, focusing structure forming materials and support structure forming materials that may cause degraded electrical characteristics over time resulting from electron bombardment.

With reference to FIGS. 1–8, while the exact mechanism that produces internal components, and in particular, a support structure that has electrical characteristics that will not degrade over time of the present invention is not known for sure, these results are probably a result of locally reduced oxygen levels in internal components. The support structure contains oxygen that is typically present in the form of oxides such as, for example, aluminum oxide, chromium oxide, and titanium oxide. The oxygen reacts with contaminants located on the surfaces of prior art support structures. These contaminants include carbon and carbon compounds that react with oxygen in the prior art structure so as to produce product compounds. These product compounds may include carbon monoxide and/or carbon dioxide gas.

As discussed above, the reasons that the dry cleaning processes of the present invention produces a support structure that has electrical characteristics that do not degrade over time is not known for sure. However, it is thought that the removal of oxygen affects the resistivity of the support structure and allows spatially nonuniform resistivity to form over time. By removing contaminants on the surface, it is believed that this removal of oxygen is significantly reduced. However, any of a number of other different reactions and processes may be responsible for the desirable result obtained by exposing the support structure to a dry cleaning process.

Thus, the present invention provides internal components that have electrical characteristics that do not degrade over time. Because the electrical characteristics of the internal components of the present invention is maintained, the present embodiment provides internal components that have uniform resistance and that do not produce spatially nonuniform resistivity. This prevents regions of the visible display that are not properly illuminated and decreases the chances that any electrical arcing will occur.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order best to explain the principles of the invention and its practical application, to thereby enable others skilled in the art best to utilize the invention and various embodiments with various modifications suited to the particular use contemplated. It is intended that the scope of the invention be defined by the Claims appended hereto and their equivalents.

What is claimed is:

1. A method for making a flat panel display device comprising the steps of:

a) providing a faceplate;

b) providing a backplate coupled to said faceplate;

c) providing an internal component adapted to be disposed between said faceplate and said backplate;

d) cleaning said internal component using a dry cleaning treatment to remove contaminants therefrom such that a cleaned internal component is achieved, wherein said dry cleaning treatment further comprises the application of nitrogen plasma to said internal component; and e) coupling said backplate to said faceplate such that said cleaned internal component is disposed between said faceplate and said backplate.

* * * * *

UNITED STATES PATENT AND TRADEMARK OFFICE

CERTIFICATE OF CORRECTION

PATENT NO. : 6,398,607 B1 
DATED : June 4, 2002
INVENTOR(S) : Lawrence S. Pan, Colin D. Stanners and Theodore S. Fahlen It is certified that error appears in the above-identified patent and that said Letters Patent is hereby corrected as shown below:

Title page,
Item [54], Title should read -- METHOD FOR CLEANING INTERNAL COMPONENTS OF A FLAT PANEL DISPLAY --

Signed and Sealed this

Fifth Day of November, 2002

*Attest:*

*Attesting Officer*

JAMES E. ROGAN
*Director of the United States Patent and Trademark Office*